United States Patent [19]

Shimono et al.

[11] Patent Number: 4,583,842

[45] Date of Patent: Apr. 22, 1986

[54] DEVELOPING APPARATUS

[75] Inventors: Mamoru Shimono, Yokohama; Shinichi Hashimoto, Fujisawa; Fuminobu Nishimura, Yokohama, all of Japan

[73] Assignee: Kabushiki Kaisha Toshiba, Kawasaki, Japan

[21] Appl. No.: 661,562

[22] Filed: Oct. 16, 1984

[30] Foreign Application Priority Data

Oct. 19, 1983 [JP] Japan ..... 58-195724

[51] Int. Cl.[4] ..... G03G 15/08

[52] U.S. Cl. ..... 355/3 DD; 118/657; 366/316; 366/328

[58] Field of Search ..... 355/3 R, 3 DD; 366/315, 366/316, 325, 328; 118/656, 657

[56] References Cited

U.S. PATENT DOCUMENTS 4,146,323 3/1979 Forward et al. ..... 355/3 DD 4,433,904 2/1984 Ikemoto et al. ..... 355/3 DD

FOREIGN PATENT DOCUMENTS 53-32029 8/1978 Japan .

*Primary Examiner*—Fred L. Braun

*Attorney, Agent, or Firm*—Cushman, Darby & Cushman

[57] ABSTRACT

A developing apparatus is provided with a casing in which a toner is received and a stirring roller for stirring the toner is disposed. The stirring roller has its shaft extended parallel to a developing roller and is rotatably supported to the casing at each end. The stirring roller includes a sleeve shaft and a plurality of elliptic stirring blades arranged at regular intervals along the axial direction of the sleeve shaft. Each stirring blade is inclined at 45 degrees to the axis of the stirring roller. Two pairs of adjacent stirring blades located individually on both end portions of the sleeve shaft are each provided with a cut portion. The respective cut portions of each end pair of blades are located diametrically opposite to each other.

8 Claims, 11 Drawing Figures

DEVELOPING APPARATUS

BACKGROUND OF THE INVENTION

The present invention relates to a developing apparatus which comprises a developing agent carrier facing an image bearing member such as a drum-shaped photosensitive member, a rotatable stirring member extending parallel to the developing agent carrier, and a frame containing the developing agent carrier and the stirring member.

The stirring member of the developing apparatus of this type includes a shaft and a plurality of diskshaped or elliptic stirring blades arranged at regular intervals along the axial direction of the shaft and inclined at an angle to the axis of the shaft. As the shaft rotates, the stirring blades stir the developing agent (hereinafter referred to simply as toner), and convey the toner in an oscillatory manner along the axial direction of the shaft.

The upper halves of the stirring blades (upper portion of the stirring member), which face a toner hopper located above, mainly stir the toner, while the lower halves of the blades (lower portion of the stirring member) surrounded by the frame or casing mainly serve, in cooperation with the casing, to positively convey the toner along the axial direction.

According to such a conventional arrangement, however, trouble will be caused if a copying machine incorporating the developing apparatus is set on a slanting surface. If the toner is stirred with the shaft inclined, it will be collected by degrees at one side of the region corresponding to the lower end of the inclined stirring member, so that the toner at the upper end portion will gradually be reduced. Thus, the supply of the developing agent to the developing agent carrier varies along the axial direction of the stirring member, exerting a bad influence on an image density.

SUMMARY OF THE INVENTION

The present invention is contrived in consideration of these circumstances, and is intended to provide a developing apparatus capable of being set in an inclined position without adversely affecting an image density.

In order to attain the above object, there is provided a developing apparatus which comprises a casing storing a developing agent, a developing agent carrier extending in one direction in the casing and carrying the developing agent on the surface thereof, a means for stirring and conveying the developing agent, the means extending in one direction in the casing and including a stirring means for stirring the developing agent stored in the casing, a conveying means for reciprocating the developing agent in the casing along the one direction, and a nonconveyance means arranged at both ends of the stirring and conveying means along one direction and adapted to cause the developing agent to stagnate when the developing agent reaches the end portions.

DETAILED DESCRIPTION OF THE PREFERRED EMBODIMENT

A developing apparatus according to one embodiment of the present invention applied to an electronic copying machine will now be described in detail with reference to the accompanying drawings of FIGS. 1 to 10B.

Figure 1:
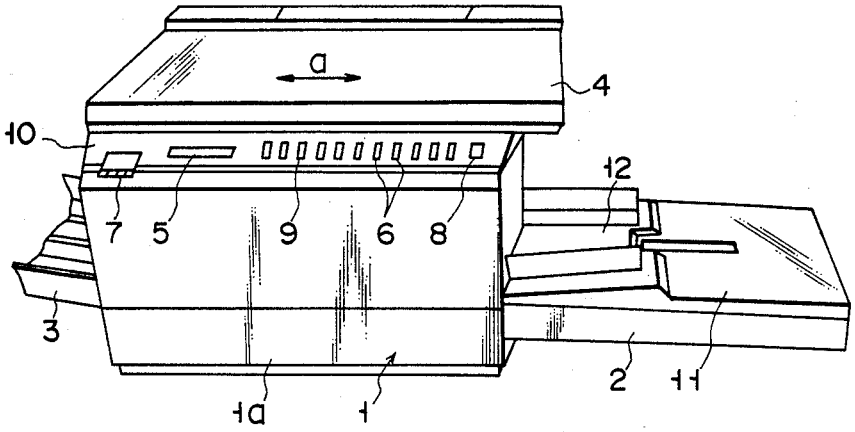
FIG. 1 is a perspective view showing an electronic copying machine incorporating a developing apparatus according to one embodiment of the present invention.

FIG. 1 shows an outline of the electronic copying machine which is provided with the developing apparatus of the one embodiment. In FIG. 1, numeral 1 designates a copying machine housing containing a copying mechanism. Numerals 2 and 3 designate a sheet cassette and a sheet receiving tray attached to the right and left-hand side portions of the copying machine housing 1, respectively. An original table 4 capable of reciprocating in the longitudinal direction (indicated by arrow a) of the copying machine housing 1 is mounted on the top of the housing 1. Provided at the front edge portion of the top face of the copying machine housing 1 is a console panel 10 on which are arranged a display 5 and a group of input keys 9 including a ten-key unit 6, an exposure setter 7, a print key 8, etc.

The cassette cover 11 of the sheet cassette 2 constitutes a sheet-bypass guide 12 which supplies manual sheets.

Figure 2:
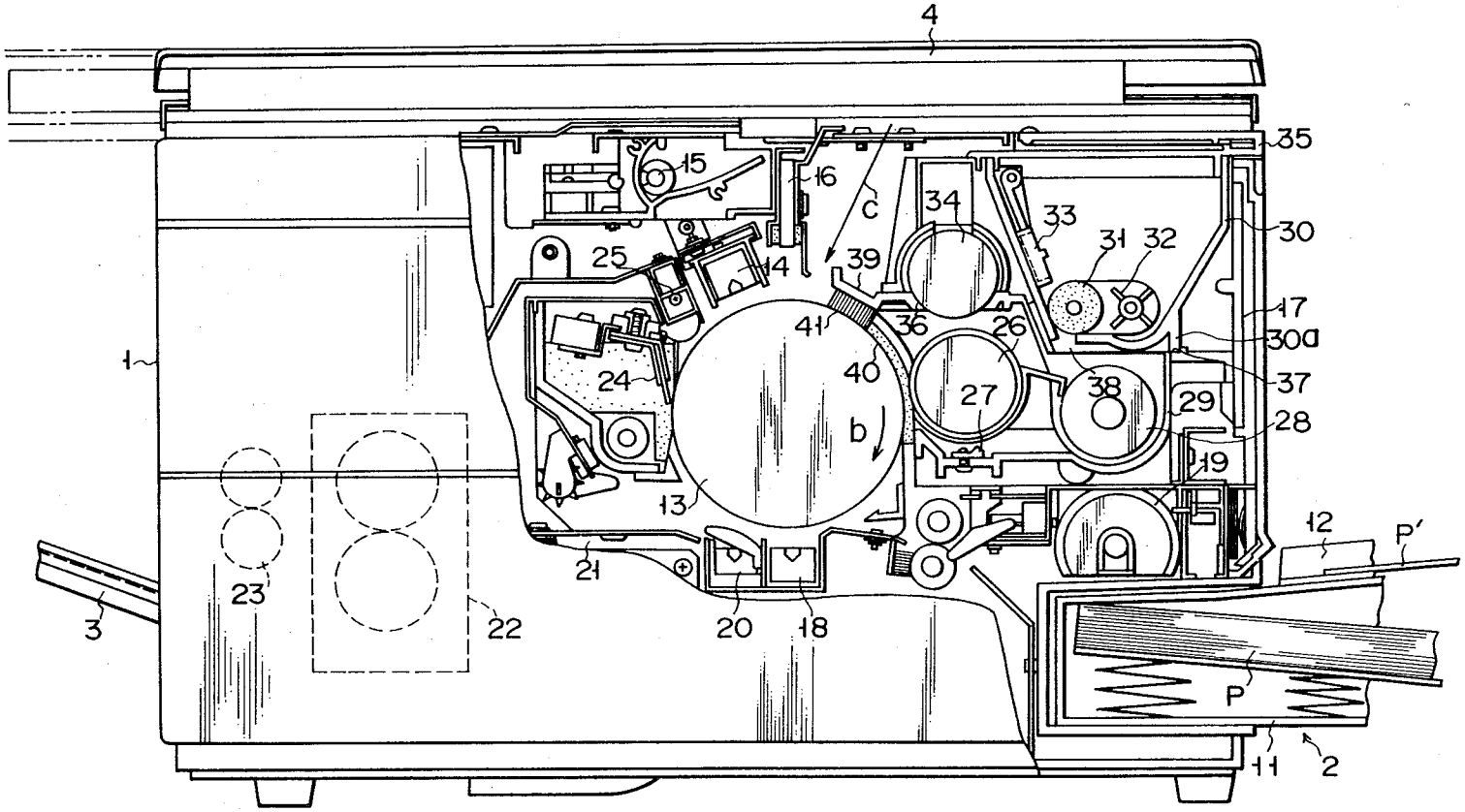
FIG. 2 is a sectional view showing the internal mechanism of the electronic copying machine of FIG. 1.

Referring now to FIG. 2, the internal mechanism of the electronic copying machine will be described.

In FIG. 2, numeral 13 designates a drum-shaped photosensitive body as an image bearing member which is disposed substantially in the central portion of the copying machine housing 1. The photosensitive body 13 is rotated clockwise as indicated by arrow b in synchronism with the original table 4 by a drive mechanism (not shown). The surface of the photosensitive body 13 is uniformly charged by a charger 14. Reflected light from an original uniformly irradiated by an exposure lamp 15 is projected on the photosensitive body 13 by a condensing light transmitter (or Selfoc lens array; trademark) 16. Thus, an electrostatic latent image corresponding to an image impression of the original is formed on the photosensitive body 13. The electrostatic latent image formed in this manner is developed into a developing agent image (hereinafter referred to as a toner image) by a developing apparatus 17. Then, the toner image is placed opposite a transfer charger 18 in response to the rotation of the photosensitive body 13.

A sheet P or P′ supplied automatically or manually is delivered by a sheet feeding unit 19 to a transfer section which is defined between the photosensitive body 13 and the transfer charger 18. In this transfer section, the toner image previously formed on the photosensitive body 13 is transferred to the surface of the sheet P or P' by the transfer charger 18. Then, the sheet P or P' with the toner image thereon is separated from the photosensitive body 13 by a separation charger 20 for AC corona discharge. Thereafter, the sheet P or P' passes through a conveying path 21 to reach a fixing unit 22, where the toner image is melted and fixed to the sheet P or P'. Then, the sheet P or P' is discharged into the removable tray 3 by exit rollers 23.

After the toner image is transferred to the sheet P or P', the toner remaining on the photosensitive body 13 is cleared out by a cleaning unit 24, and the potential on the photosensitive body 13 is lowered below a predetermined level to be ready for the next copying cycle.

The surface of the photosensitive body 13 is slit-exposed to the exposed image of the original through the optical system of the copying machine, as indicated by arrow c in FIG. 2.

The developing apparatus 17 comprises a developing roller 26 as a developing agent carrier disposed beside the photosensitive body 13, a doctor 27 facing the developing roller 26 to control the thickness of the toner layer on the peripheral surface of the roller 26, and a stirring roller 28 as a stirring member located on the opposite side of the developing roller 26 to the photosensitive body 13, and housed in a frame 29 which constitutes a developing vessel of the developing apparatus 17. The developing apparatus 17 further comprises a toner hopper 30 removably mounted on the top portion of the frame 29, a developing agent supply roller 31 disposed in the toner hopper 30, a stirring blade member 32 arranged side by side with the supply roller 31 for rotation, a lever-type detection switch member 33 for detecting the presence of toner in the hopper 30, a developing agent density detector 34, and a lid 35 of the hopper 30. The original table 4 is designed so that it cannot move unless the hopper 30 is closed by the lid 35.

The lower portion of the developing apparatus 17 is surrounded by the frame 29 as a casing. The developing roller 26, the doctor 27, and the stirring roller 28 are housed in the frame 29, and so constitute a developing section. The toner hopper 30, the developing agent supply roller 31 in the toner hopper 30, the stirring blade member 32, and the detection switch 33 constitute a developing agent supply section, and is located above the developing section off to the right. An upper frame 36 forming the top of the developing vessel and the density detector 34 on the upper frame 36 constitute a detecting section, located off to the upper left of the developing section.

In FIG. 2, the hatch marks on the broken-away profiles of the members have been omitted.

In the developing apparatus 17 constructed in this manner, the frame 29 forming the developing vessel has a bearing surface 37 in the region right over the stirring roller 28 at the rear portion, that is, on the opposite side of the developing roller 26 to the photosensitive body 13. The bearing surface 37, which supports the bottom end portion 30*a* of the hopper 30, is lower in level than the front side of the frame 29 so that the hopper 30 penetrates the space of the developing section. Therefore, the capacity of the hopper 30 is increased correspondingly. Namely, the hopper capacity may be secured without positively projecting the top of the hopper 30 upward. In addition, the supply roller 31 can be located closer to the stirring roller 28 thereunder. Thus, a lower opening 38 of the hopper 30 is brought close to the upper portion of the stirring roller 28 so that the toner can be dropped from the supply roller 31 through the lower opening 38 to the region over the stirring roller 28 to start the stirring operation. This increases the effect of the stirring.

The upper frame 36 is in the form of a ceiling which covers the region over the developing roller 26. The upper frame 36 has a penthouse-shaped projected portion 39 overhanging on the side facing the photosensitive body 13. The projected portion 39 is located on the upper side of a developing region 40 of the developing apparatus 17 with respect to the rotating direction of the photosensitive body 13. Thus, the projected portion 39 positively prevents stray light from getting into the developing region 40 at the time of slit exposure (indicated by arrow c) and prevents the toner in the developing region 40 from scattering into the optical path for exposure that is located above.

As shown in FIG. 2, a brush 41 is attached to the lower surface of the projected portion 39 so as to be in contact with the peripheral surface of the photosensitive body 13. Thus, the projected portion 39 provides an additional effect. The same effect may be obtained if the projected portion 39 is located closer to the peripheral surface of the photosensitive body 13 instead of providing the brush 41.

The projected portion 39 and the brush 41 extend along the axial direction of the photosensitive body 13 to cover the full length thereof.

Figure 3:
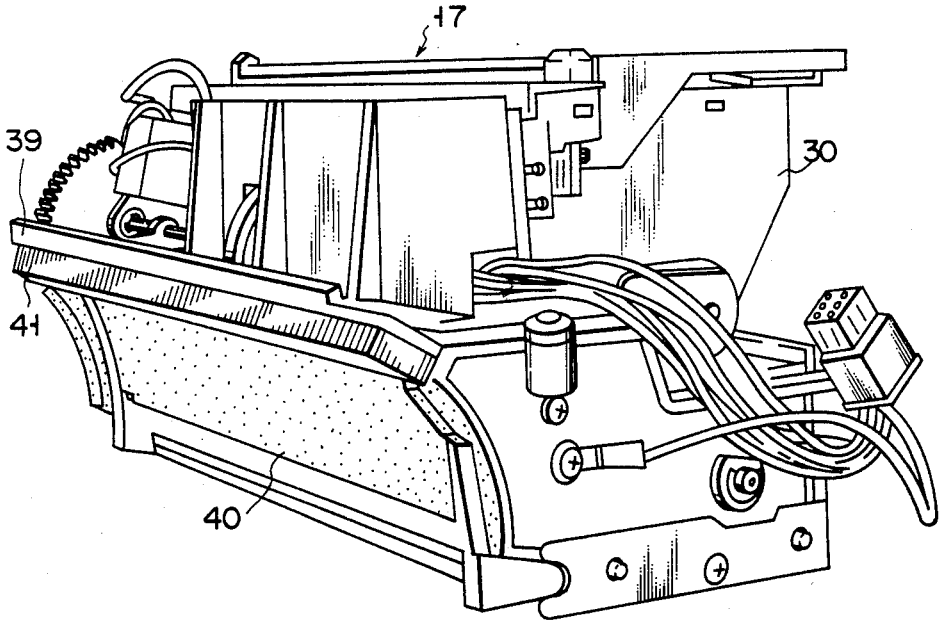
FIG. 3 is a perspective view showing the developing apparatus according to the embodiment of the invention extracted from the electronic copying machine of FIG. 1.

As shown in FIG. 3, the developing apparatus 17 is assembled as a single unit, and is combined with the hopper 30 in the copying machine housing 1.

In the present embodiment, the projected portion 39 is formed integrally with the upper frame 36. Naturally, however, the upper frame 36 may be formed independently of the projected portion 39. Also, the projected portion 39 may be attached to a suitable member separate from the frame 36.

Figure 4:
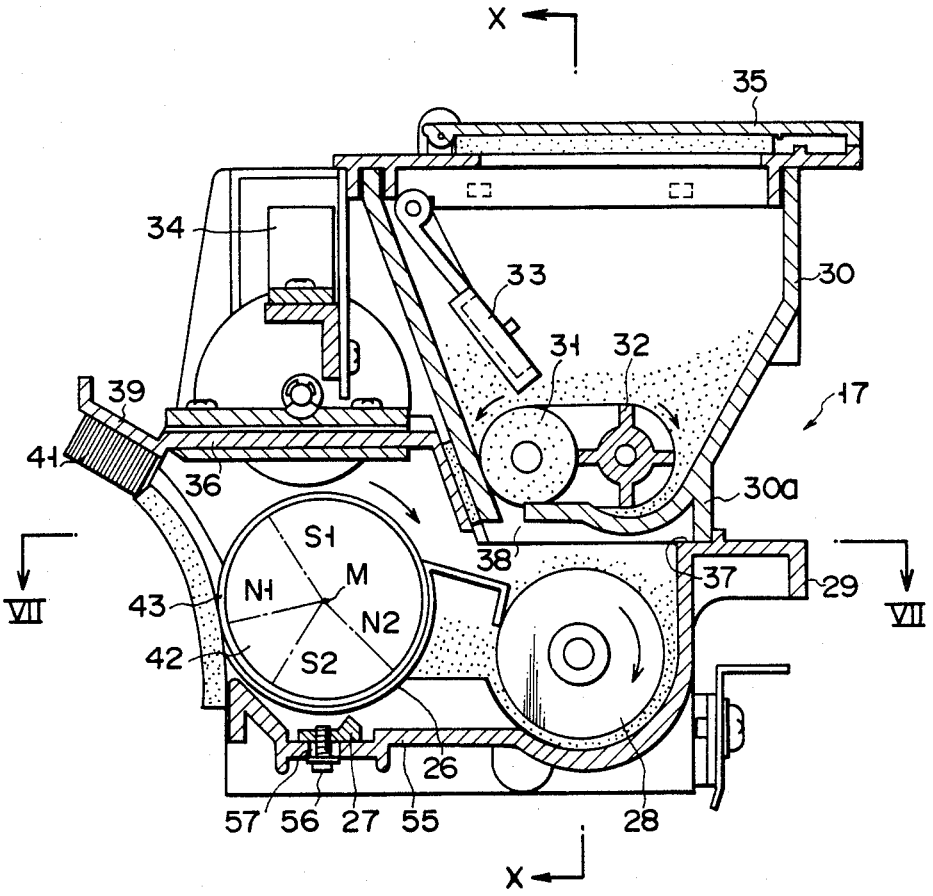
FIG. 4 is a vertical sectional view showing the developing apparatus of FIG. 3.

In FIG. 4, the developing roller 26 is formed of the so-called sleeve-type developing roller which includes a fixed magnetic roller 42 and a rotatable sleeve 43 fitted on the magnetic roller 42. The magnetic roller 42 has a four-pole roller structure, consisting of a pair of north poles (first north pole N1 of 1,000 gauss and second north pole N2 of 200 gauss) and a pair of south poles (first south pole S1 of 550 gauss and second south pole S2 of 700 gauss) which are arranged at suitable angular intervals around the center M. The magnetic roller 42 is designed so that the individual poles are located in the following proper positions relative to the photosensitive body 13.

The poles N1, S1, N2 and S2 on the magnetic roller 42 should be positioned as follows. The first north pole N1 is positioned at 1 to 5 degrees (in the counterclockwise direction) below a straight line connecting the center M of the magnetic roller 42 and the center of the photosensitive member 13. The first and second south poles S1 and S2 are positioned so that ∠N1MS1 in the clockwise direction and ∠N1MS2 in the counterclockwise direction, with respect to the position of the first north pole N1, are 70 degrees and 50 degrees, respectively. The second north pole N2 is positioned so that ∠S2MN2 in the counterclockwise direction with respect to the position of the second south pole S2 is 80 degrees.

Figure 5:
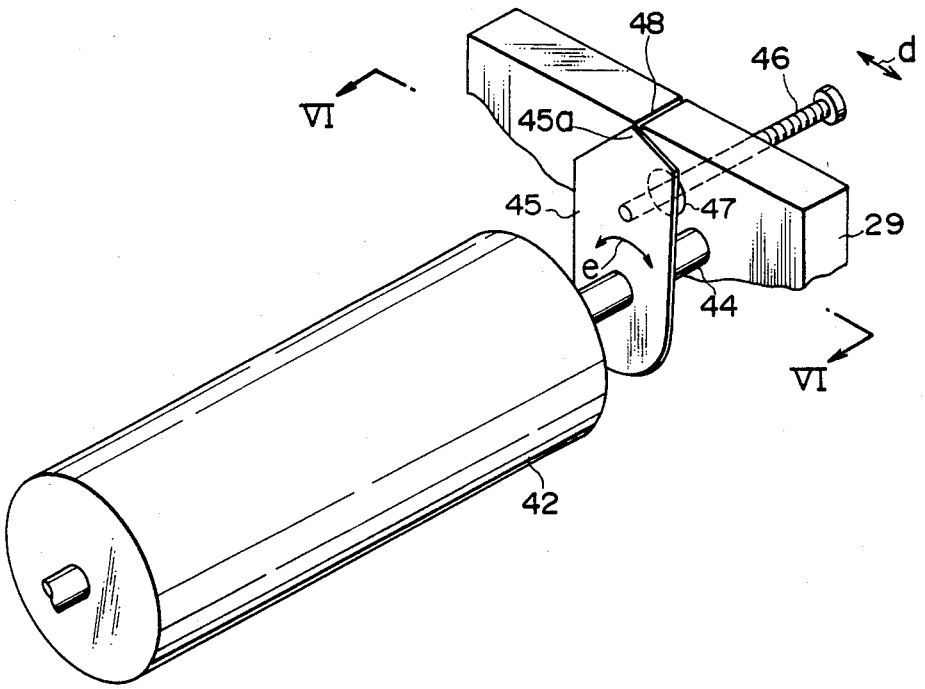
FIG. 5 is a perspective view showing a magnetic roller adjusting mechanism.
Figure 6:
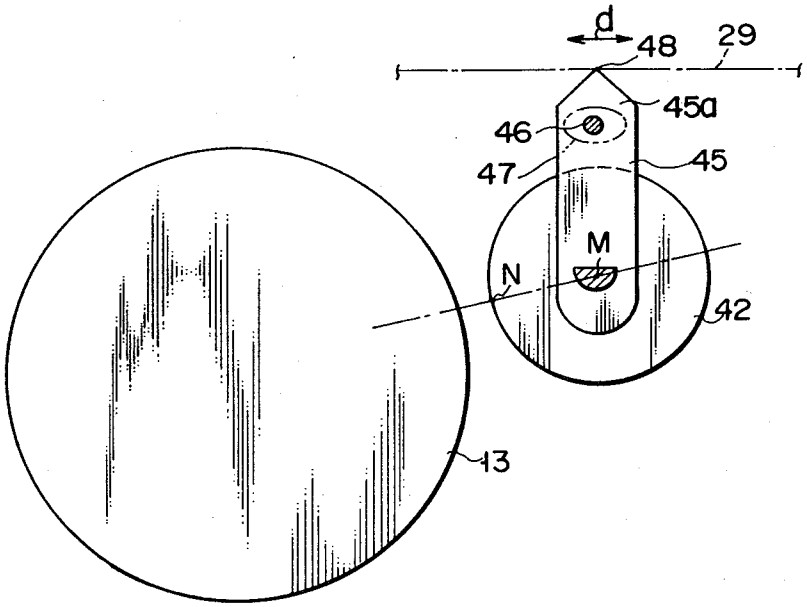
FIG. 6 is a side sectional view of the developing roller taken along line VI—VI of FIG. 5.

FIGS. 5 and 6 show a specific adjusting unit for finely adjusting the magnetic roller 42 to a proper angular position.

In this adjusting unit, one end portion of a shaft 44 of the magnetic roller 42 is rotatably supported on the frame 29. The shaft 44 is provided with a stopper and is fitted with an adjusting plate 45. An adjusting bolt 46 is passed through a loose hole 47 in the frame 29 from the outside thereof. The tip end of the adjusting bolt 46 is screwed into the adjusting plate 45. A triangular pointer portion 45*a* is formed at one end of the adjusting plate 45. The pointer portion 45*a* is aligned with a mark 48 in the form of a groove in the top face of the frame 29. In this state, the bolt 46 is fixed to the frame 29 by using a nut or any other suitable fixing means (not shown). As a result, the roller 42 is prevented from rotating, and the north poles of the roller 42 are located in proper angular positions relative to the photosensitive body 13.

In changing or adjusting the angular position of the roller 42, the bolt 46 is removed from the fixing means. The pointer portion 45*a* is moved crosswise within the range of the loose hole 47, as indicated by arrow d, so that the adjusting plate 45 is rocked as indicated by arrow e. As a result, the roller 42 is rotated together. Thus, when the roller 42 reaches a desired angular position, the bolt 46 is fixed in the aforesaid manner. The displacement of the roller 42 achieved by the adjustment can be detected from a deflection of the pointer portion 45*a* from the reference mark 48. Besides the mark 48, a scale representing the deflection may be provided for this purpose.

Figure 8:
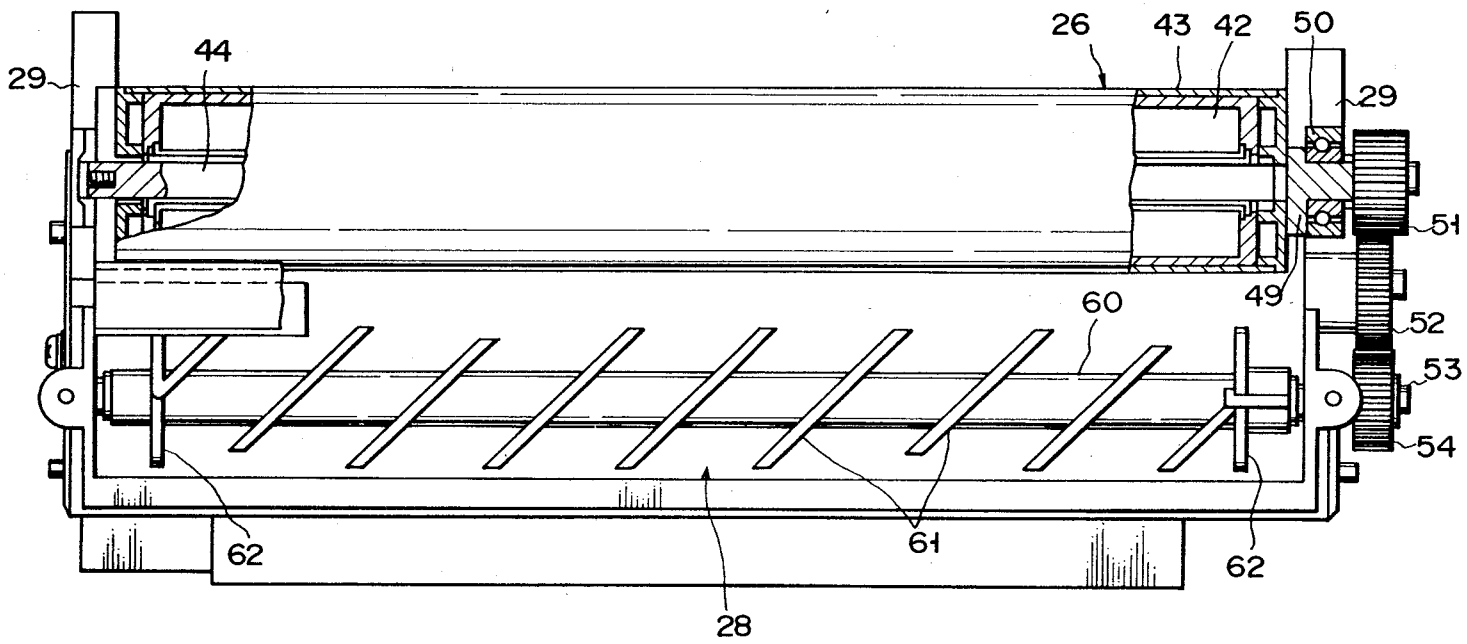
FIG. 8 is a broken away, top view of a stirring roller and a developing roller taken along line VIII—VIII of FIG. 4.

As shown in FIG. 8, the sleeve 43 is fitted on the outer peripheral surface of the magnetic roller 42. A shaft 49 protruding from one end portion (right-hand end portion) of the sleeve 43 is rotatably supported on the frame 29 by means of a bearing 50. A gear 51 is fixed on one end portion of the shaft 49. The gear 51 is connected by means of an intermediate gear 52 to a gear 54 which is fixed on one end portion of a shaft 53 of the stirring roller 28. Thus, the sleeve 43, along with the stirring roller 28, is continually rotated in the clockwise direction of FIG. 4 by a drive mechanism (not shown) in copying operation.

Turning now to FIG. 4, the doctor 27 under the developing roller 26 is located between the second north pole N2 and the second south pole S2 of the magnetic roller 42, and is fixed to a bottom plate 55 of the frame 29 having a horizontal upper surface by means of a bolt 56. The bolt 56 is passed upward through a slot 57 in the bottom plate 55 and screwed into the doctor 27. If the bolt 56 is loosened, the doctor 27 can horizontally move along the upper surface of the bottom plate 55 within the range of the length of the slot 57.

Figure 7:
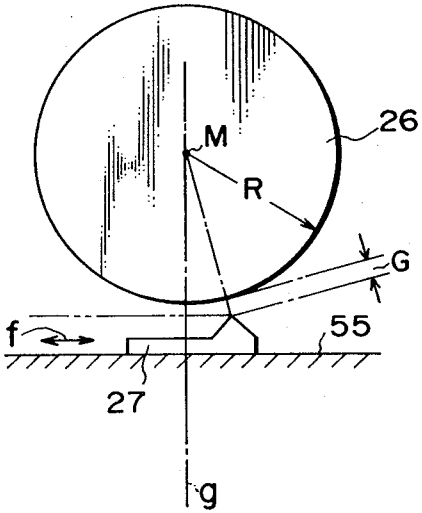
FIG. 7 is a side view schematically showing the construction of a doctor.

As indicated by arrow f in FIG. 7, the doctor 27 moves along a tangent line perpendicular to a vertical line g which extends from the center M of the roller 26 toward the upper surface of the bottom plate 55 supporting the doctor 27. The tip end of the doctor 27, which defines a gap G between itself and the peripheral surface of the roller 26, traces the trajectory indicated by a two-dot chain line.

Thus, the gap G varies as the doctor 27 moves, depending on the relationship between the locus of the horizontal tangential movement of the doctor 27 and the radius R of curvature of the peripheral surface of the roller 26. In other words, the gap G may be finely adjusted by moving the doctor 27.

Conventionally, the gap G is adjusted by moving the developing roller in its radial direction, that is, along the vertical line g of FIG. 7, with the aid of a shim or spacer. Such an adjusting process, however, requires much time and is unfit for fine adjustment. According to the method of the invention in which the gap G is adjusted by tangentially moving the doctor 27, on the other hand, it is necessary only that the doctor 27 be slid directly on the horizontal surface of the bottom plate 55 without the aid of a shim or any other spacing means. Also, this adjusting method facilitates fine adjustment of $\pm 5/100$ mm which is practically essential, and permits proper control of the thickness of the toner layer on the developing roller, thereby ensuring uniform image density.

Since the variation of the gap G along the axial direction of the developing roller 26 can be minimized by making the upper surface of the bottom plate 55 level to a certain degree, the horizontal adjustment method, as compared with the radial adjustment method, can easily eliminate the variation of the thickness of the toner layer along the axial direction of the developing roller 26.

Figure 9:
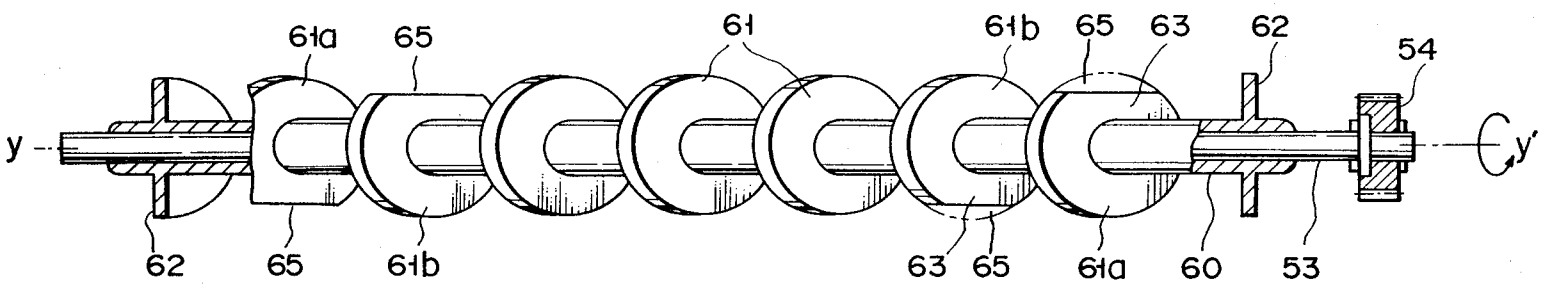
FIG. 9 is a perspective view extractively showing the stirring roller.

Referring now to FIGS. 8 to 10, the construction of the stirring roller 28 will be described in detail.

The stirring roller 28 has its shaft 53 extending parallel to the developing roller 26, and is rotatably supported on the frame 29 at each end. As mentioned before, the stirring roller 28 is interlocked with the developing roller 26 by means of the gear 54 which is mounted on the one end of the shaft 53. The stirring roller 28 includes a sleeve shaft 61 and a plurality of elliptic stirring blades 61 arranged at regular intervals along the axial direction of the sleeve shaft 60. As shown in FIG. 9, each stirring blade 61 is inclined at a predetermined angle, e.g., 45 degrees, to the axis y-y' of the stirring roller 28.

Alternatively, the sleeve shaft 60 may be formed integrally with the shaft 53.

The stirring roller 28 with the stirring blades 61 thereon rotates in synchronism with the developing roller 26. The upper half portion of the stirring roller 28 to receive the toner dropped by the developing agent supply roller 31 (FIG. 4) mainly serves to positively stir the toner. The lower half portion of the stirring roller 28, in conjunction with the casing of the frame 29 surrounding the lower halves of the blades 61, mainly serves to positively carry the toner along the axial direction.

Disk-shaped dashboards 62 defining the toner feed region are arranged individually on both end portions of the stirring roller 28, extending at right angles to the axis y-y' of the shaft 53. Thus, the toner is stirred and fed within the region between the two dashboards 62.

As seen from the perspective view of FIG. 9, at least two pairs of adjacent stirring blades 61*a* and 61*b* located individually on both end portions of the sleeve shaft 60 are each provided with a cut portion 65. A portion 63 of the peripheral edge of each of the right-hand end pair of stirring blades 61*a* and 61*b* is cut as indicated by chain line. The left end pair of stirring blades 61*a* and 61*b* is cut in the same manner. The respective cut portions 65 of each end pair of blades 61*a* and 61*b* are located diametrically opposite to each other.

Thus, the cut portions 65 are symmetrically formed on the two adjacent blades 61*a* and 61*b* at each end portion, constituting a nonconveyance section where the developing agent is not conveyed. As the stirring roller 28 rotates, therefore, the stirring blades 61 operate in the manner shown in FIGS. 10A and 10B.

Figure 10A:
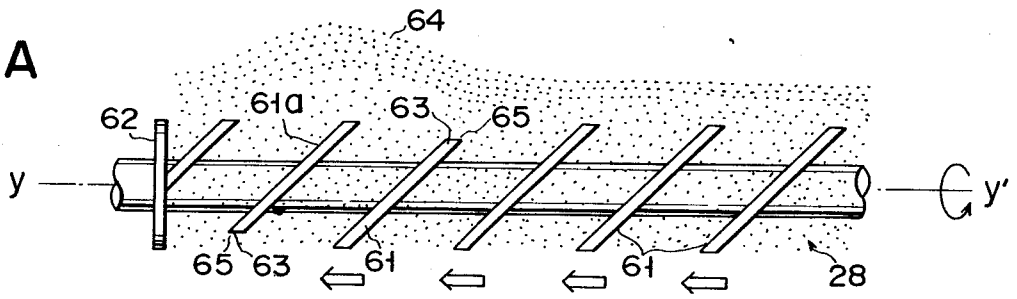
FIGS. 10A and 10B are front views of the stirring roller taken along line X—X of FIG. 4, showing different operating states.
Figure 10B:
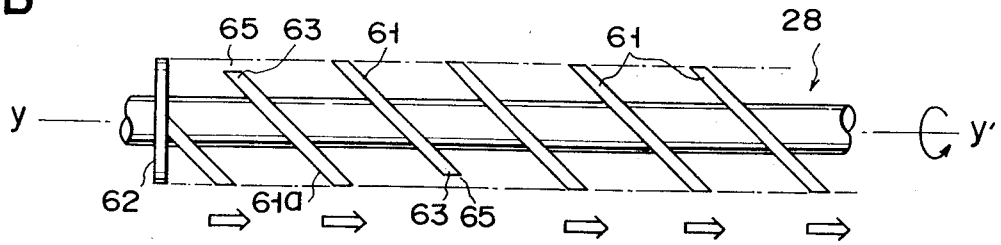

FIGS. 10A and 10B are front views taken along line X—X of FIG. 4. The upper side of the roller 28 constitutes a stirring section, and the lower side a conveying section. When the roller 28 is in the position shown in FIG. 10A, the toner is positively carried to the left by the stirring blades 61 in the conveying section, as indicated by arrows. When the roller 28 is rotated 180 degrees from the position of FIG. 10A to take the position shown in FIG. 10B, the stirring blades 61 force the toner back in the opposite direction, i.e., to the right. Thus, the toner is moved from side to side as the roller 28 rotates. In practice, if the shaft 53 is inclined at an angle to the horizontal plane in the state of FIG. 10A, the toner is conventionally collected on only one side of the lower end. Accordingly, the toner at the upper end becomes insufficient, exerting a bad influence on image quality.

In order to avoid this, according to the present embodiment of the invention, at least one pair of stirring blades 61*a* and 61 b at each end portion of the stirring roller 28 is provided with a cut portion 65 to be used as a nonconveyance section.

The presence of the cut portions 65 deprives, e.g., the blade 61*a* of FIG. 10A, of the positive leftward conveying force in the conveying section on the lower side where the cut portion 65 of the blade 61*a* is located. Accordingly, the toner stagnates at the cut portions 65. As shown in FIG. 10B, the cut portion 65 of the blade 61*b* lacks a positive rightward conveying force in the conveying section, causing the toner to stagnate. Thus, the toner always partially stagnates at the end portions of the roller 28 or in the vicinity thereof, forming a swelling portion 64 on each side of the roller 28, as indicated by the broken lines in FIG. 10A. Therefore, even if the shaft 53 is inclined at an angle to the horizontal plane, the swelling portion 64 will be formed at the upper end portion of the slanted shaft 53 to obviate the possibility of too little toner being supplied. Thus, a satisfactory image can be produced without the variations in image density attributed to the inclination of the shaft 53.

In the embodiment described above, a pair of blades at each end portion of the stirring roller has a cut portion. However, at least some effect may be produced if the cut portion is formed on a single blade at each end portion.

Although an illustration of the present invention has been described in detail, it is to be understood that the invention is not limited to this arrangement, and that various changes and modifications may be effected therein by one skilled in the art without departing from the scope or spirit of the invention.

According to the present invention, as described above, the peripheries of at least a pair of stirring blades of a stirring roller at each end portion thereof are partially cut on diametrically opposite sides. Even if the shaft of the stirring roller is inclined, therefore, the blades at the end portions can positively cause the developing agent to stagnate. Thus, the developing agent may be saved without substantially retarding the stirring effect. Moreover, it is possible to eliminate the bad influence of leakage of the developing agent on the quality of the developed image.

What is claimed is:

1. A developing apparatus comprising:

a casing storing a developing agent;

a developing agent carrier extending in one direction in the casing and carrying the developing agent on the surface thereof; and means for stirring and conveying the developing agent, said means extending in said one direction in the casing and including stirring means for stirring the developing agent stored in the casing, conveying means for reciprocating the developing agent in the casing along said one direction, and nonconveyance means arranged at both end portions of the stirring and conveying means along said one direction and adapted to cause the developing agent to stagnate when the developing agent reaches the end portions.

2. The developing apparatus according to claim 1, wherein said stirring and conveying means includes a shaft rotatably extending along said one direction, and a plurality of stirring blades arranged at regular intervals along said one direction on the outer periphery of the shaft, each said stirring blade inclining at a predetermined angle to the axis of the shaft.

3. The developing apparatus according to claim 2, wherein said stirring means is formed of the upper halves of the stirring blades.

4. The developing apparatus according to claim 2, wherein the lower ends of said stirring blades are located close to the bottom portion of the casing, and said conveying means is formed of the lower halves of the stirring blades and the bottom portion of the casing.

5. The developing apparatus according to claim 4, wherein those stirring blades located individually at both ends, out of said plurality of stirring blades, have a first cut portion on part of the outer periphery thereof, and said nonconveyance means includes the respective first cut portions of the stirring blades at the ends.

6. The developing apparatus according to claim 5, wherein said nonconveyance means further includes second cut portions formed individually on those stirring blades which adjoin the stirring blades at the ends, each said second cut portion being located diametrically opposite to each corresponding first cut portion.

7. The developing apparatus according to claim 2, wherein each said stirring blade is formed of an elliptic plate.

8. The developing apparatus according to claim 2, wherein said developing agent carrier is rotatable, and said shaft is rotated as the developing agent carrier rotates.

* * * * *